US006311348B1

(12) United States Patent
Luff et al.

(10) Patent No.: US 6,311,348 B1
(45) Date of Patent: Nov. 6, 2001

(54) BED ASSEMBLY WITH AN AIR MATTRESS AND CONTROLLER

(75) Inventors: Lawrence E. Luff; Steven R. Westerfeld, both of Batesville; Ryan A. Reeder, Brookville, all of IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/546,884

(22) Filed: Apr. 10, 2000

Related U.S. Application Data

(63) Continuation of application No. 09/064,272, filed on Apr. 22, 1998, now Pat. No. 6,079,065.

(51) Int. Cl.[7] ..... A47B 7/02; A47C 27/08

(52) U.S. Cl. ..... 5/618; 5/613; 5/616; 5/710; 5/713

(58) Field of Search ..... 5/618, 617, 616, 5/613, 710, 713

(56) References Cited

U.S. PATENT DOCUMENTS

| | | |
|---|---|---|
| 2,996,732 | 8/1961 | Draper . |
| 3,921,230 | 11/1975 | Hanning et al. . |
| 4,066,072 | 1/1978 | Cummins . |
| 4,224,706 | 9/1980 | Young et al. . |
| 4,231,019 | 10/1980 | Junginger et al. . |
| 4,306,322 | 12/1981 | Young et al. . |
| 4,394,784 | 7/1983 | Swenson et al. . |
| 4,435,862 | 3/1984 | Callaway . |
| 4,449,261 | 5/1984 | Magnusson . |
| 4,542,547 | 9/1985 | Sato . |
| 4,679,264 | 7/1987 | Mollura . |
| 4,686,722 | 8/1987 | Swart . |
| 4,745,647 | 5/1988 | Goodwin . |
| 4,787,104 | 11/1988 | Grantham . |
| 4,797,962 | 1/1989 | Goode . |
| 4,829,616 | 5/1989 | Walker . |

(List continued on next page.)

FOREIGN PATENT DOCUMENTS

| | | |
|---|---|---|
| 1 178 719 | 11/1984 | (CA) . |
| 1 224 888 | 7/1987 | (CA) . |
| 627 060 A5 | 12/1981 | (CH) . |
| 1778 769 | 8/1971 | (DE) . |
| 24 20 598 A1 | 11/1975 | (DE) . |
| 0 178 951 | 4/1986 | (EP) . |
| 0 220 708 | 5/1987 | (EP) . |
| 0 228 233 | 7/1987 | (EP) . |
| 0 261 830 | 3/1988 | (EP) . |
| 0 302 579 | 2/1989 | (EP) . |
| 0 341 570 | 11/1989 | (EP) . |
| 0 453 363 | 10/1991 | (EP) . |
| 4-322611 | 11/1992 | (JP) . |
| WO 96/13947 | 5/1996 | (WO) . |

*Primary Examiner*—Michael F. Trettel
*Assistant Examiner*—James M Hewitt
(74) *Attorney, Agent, or Firm*—Barnes & Thornburg

(57) ABSTRACT

A method of upgrading a bed assembly from (a) a first configuration in which the bed assembly includes a foam mattress, an articulating frame for supporting the foam mattress, and a drive system for moving at least one section of the articulated frame, to (b) a second configuration in which the bed assembly includes an air mattress, the articulating frame, and the drive system, is disclosed. The method includes the steps of removing the foam mattress from the articulating frame, placing an air mattress that includes at least one air bladder on the articulating frame, coupling an air control module pneumatically to the at least one air bladder, and coupling the air control module electrically to the drive system so that command signals received by the drive system to adjust pressure of the at least one air bladder are routed from the drive system to the air control module to operate the air control module to adjust pressure of the at least one air bladder.

13 Claims, 4 Drawing Sheets

U.S. PATENT DOCUMENTS

| | | |
|---|---|---|
| 4,839,932 | 6/1989 | Williamson . |
| 4,890,344 | 1/1990 | Walker . |
| 4,897,890 | 2/1990 | Walker . |
| 4,944,060 | 7/1990 | Peery et al. . |
| 4,949,412 | 8/1990 | Goode . |
| 4,982,466 | 1/1991 | Higgins et al. . |
| 4,986,738 | 1/1991 | Kawasaki et al. . |
| 4,995,124 | 2/1991 | Wridge, Jr. et al. . |
| 4,999,867 | 3/1991 | Toivio et al. . |
| 5,020,176 | 6/1991 | Dotson . |
| 5,035,016 | 7/1991 | Mori et al. . |
| 5,044,029 | 9/1991 | Vrzalik . |
| 5,062,167 | 11/1991 | Thomas et al. . |
| 5,062,169 | 11/1991 | Kennedy et al. . |
| 5,073,999 | 12/1991 | Thomas et al. . |
| 5,090,077 | 2/1992 | Caden et al. . |
| 5,105,488 | 4/1992 | Hutchinson et al. . |
| 5,129,115 | 7/1992 | Higgins et al. . |
| 5,142,717 | 9/1992 | Everard et al. . |
| 5,509,154 | 4/1996 | Shafer et al. . |
| 5,544,376 | 8/1996 | Fromson . |
| 5,652,484 | 7/1997 | Shafer et al. . |
| 5,829,077 | 11/1998 | Neige . |
| 5,870,784 | 2/1999 | Elliott . |

BED ASSEMBLY WITH AN AIR MATTRESS AND CONTROLLER

This application is a continuation of appilcation Ser. No. 09/064,272, filed Apr. 22, 1998 now U.S. Pat. No. 6,079, 065.

BACKGROUND AND SUMMARY OF THE INVENTION

The present invention relates to a bed assembly and particularly, to a bed assembly with an air mattress and controller. More particularly, the present invention relates to a bed assembly having electrical and pneumatic circuitry to control the pressure within an air bladder of the air mattress.

Bed assemblies including mattresses having inflatable air bladders are known. Some mattresses having air bladders are used in hospitals to support patients requiring long term care and some mattresses having air bladders are used by consumers at home. Inflation of air mattresses may be accomplished by a fairly sophisticated control system having sensors that sense air pressure within one or more air bladders of the air mattress and having one or more microprocessors that control other components of the control system based on the pressure sensed by the sensors. Many conventional beds with air mattresses also include articulating frame sections that are moved to adjust the position of a patient supported by the mattress. The position of the articulated frame sections is sometimes controlled by yet another sophisticated control system. Consumers would welcome an economical bed assembly that may be purchased, initially, without an air mattress, and that may be upgraded, later, to include an air mattress.

According to the present invention, a method of upgrading a bed assembly from (a) a first configuration in which the bed assembly includes a foam mattress, an articulating frame for supporting the foam mattress, and a drive system for moving at least one section of the articulated frame, to (b) a second configuration in which the bed assembly includes an air mattress, the articulating frame, and the drive system, is disclosed. The method includes the steps of removing the foam mattress from the articulating frame, placing an air mattress that includes at least one air bladder on the articulating frame, coupling an air control module pneumatically to the at least one air bladder, and coupling the air control module electrically to the drive system so that command signals received by the drive system to adjust pressure of the at least one air bladder are routed from the drive system to the air control 6216 module to operate the air control module to adjust pressure of the at least one air bladder.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
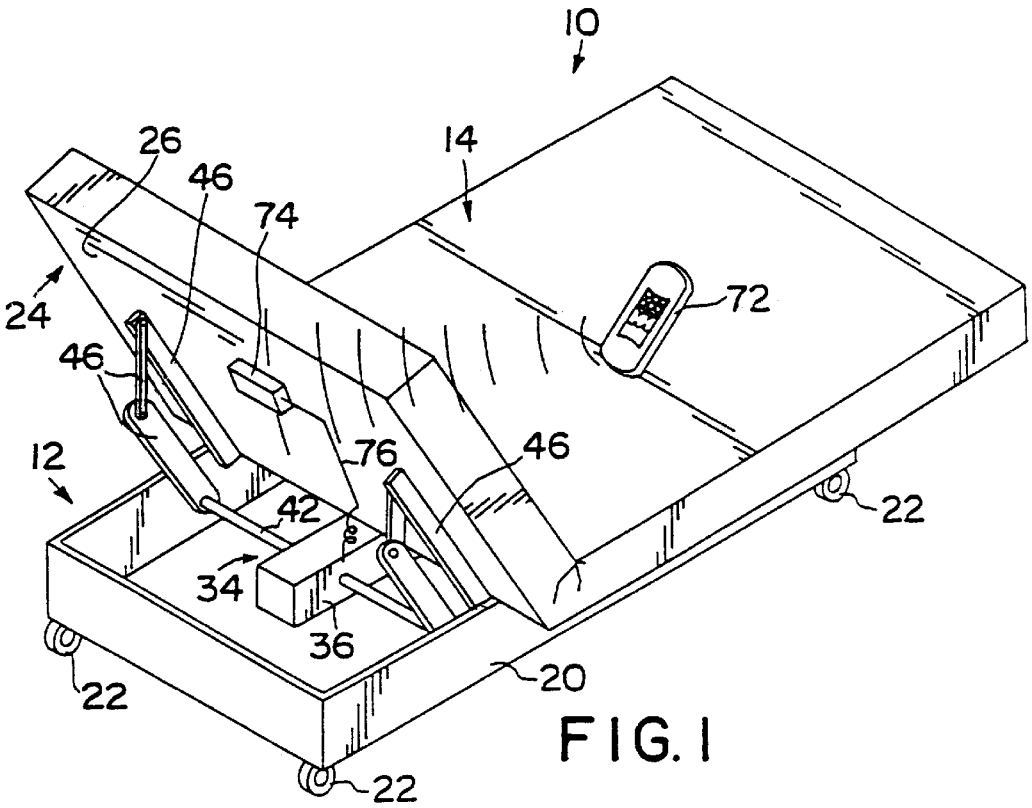
FIG. 1 is a perspective view of a bed assembly in accordance with the present invention showing a frame having an articulated section, a drive system operable to move the articulated section, a foam mattress supported by the frame, a receiver coupled to the frame, and a remote control unit which is used to transmit command signals through the receiver to the drive system to articulate the frame section.
Figure 2:
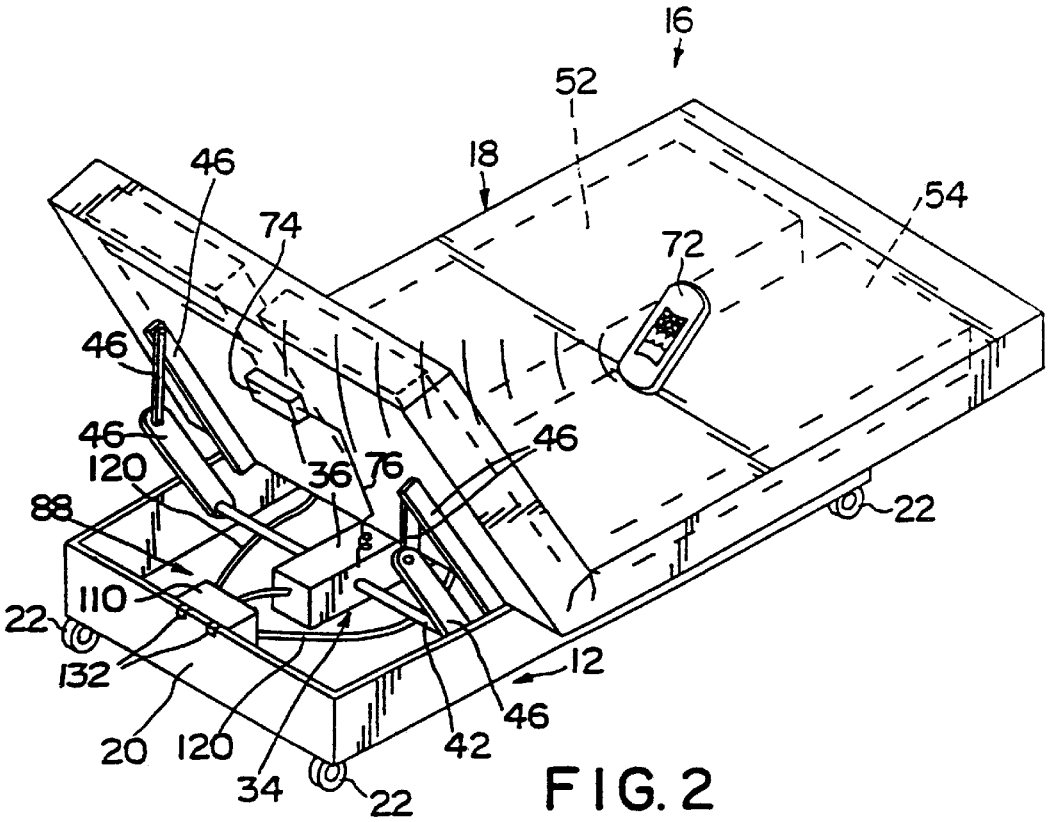
FIG. 2 is a perspective view of the bed assembly of FIG. 1 showing the foam mattress replaced by an air mattress having air bladders (in phantom), an air control module mounted to the frame, the air control module being coupled electrically to the drive system to receive command signals and line voltage power therefrom, and the air control module being coupled pneumatically to the air bladders to control the inflation and deflation thereof.

A first configuration bed assembly 10, which includes a frame 12 and a foam mattress 14 supported by frame 12 as shown in FIG. 1, is upgradable to a second configuration bed assembly 16, which includes frame 12 and an air mattress 18 supported by frame 12 as shown in FIG. 2. Frame 12 includes a rectangular base 20, a set of floor-engaging casters 22 extending downwardly from base 20, and an articulating deck 24 having head, seat, thigh, and foot frame sections 26, 28, 30, 32 as shown best in FIG. 3. Mattresses 14, 18 are each sized to fit onto articulating deck 24 as shown in FIGS. 1 and 2, respectively.

Figure 3:
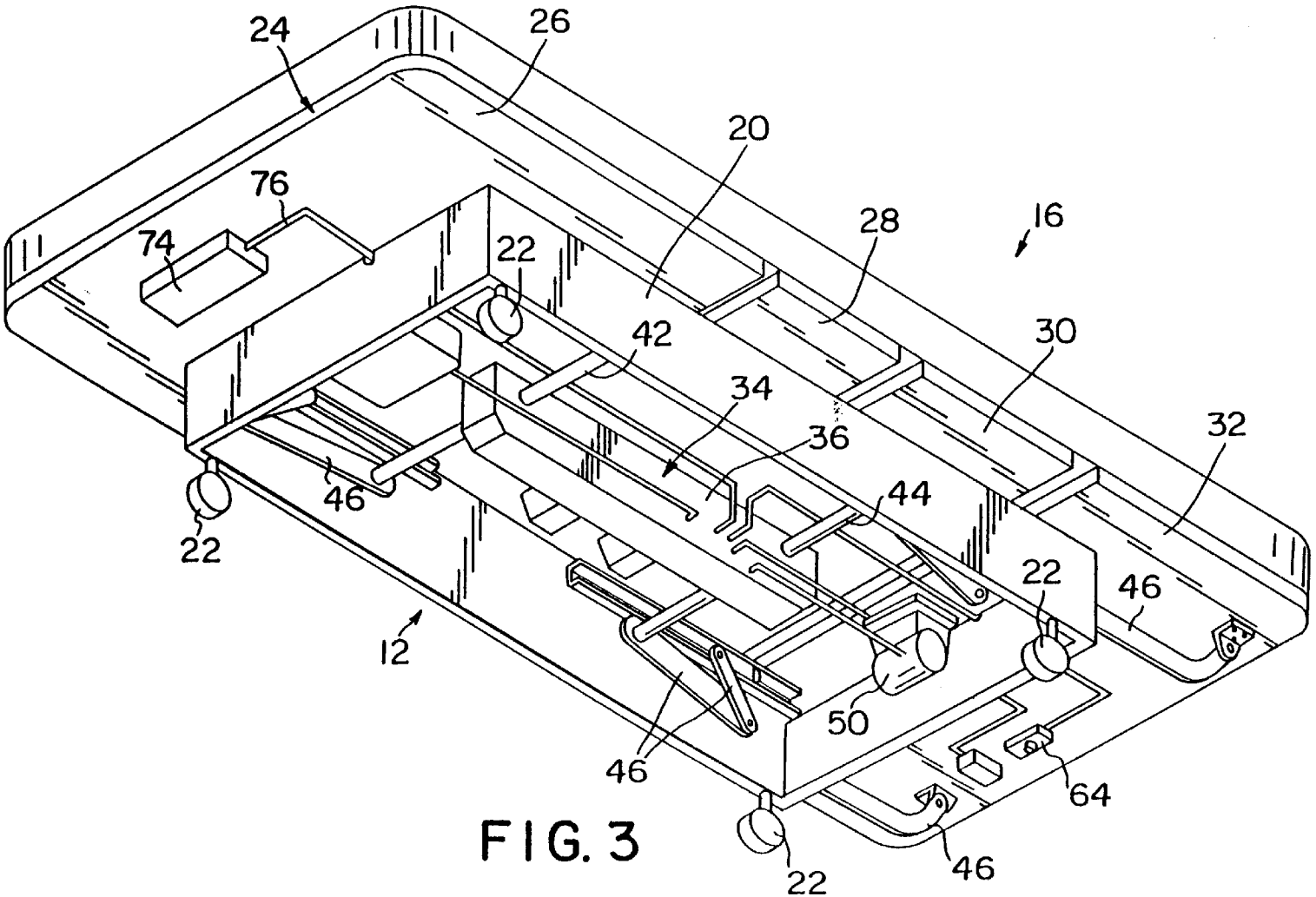
FIG. 3 is a perspective view of the underside of the bed assembly of FIG. 2.
Figure 4:
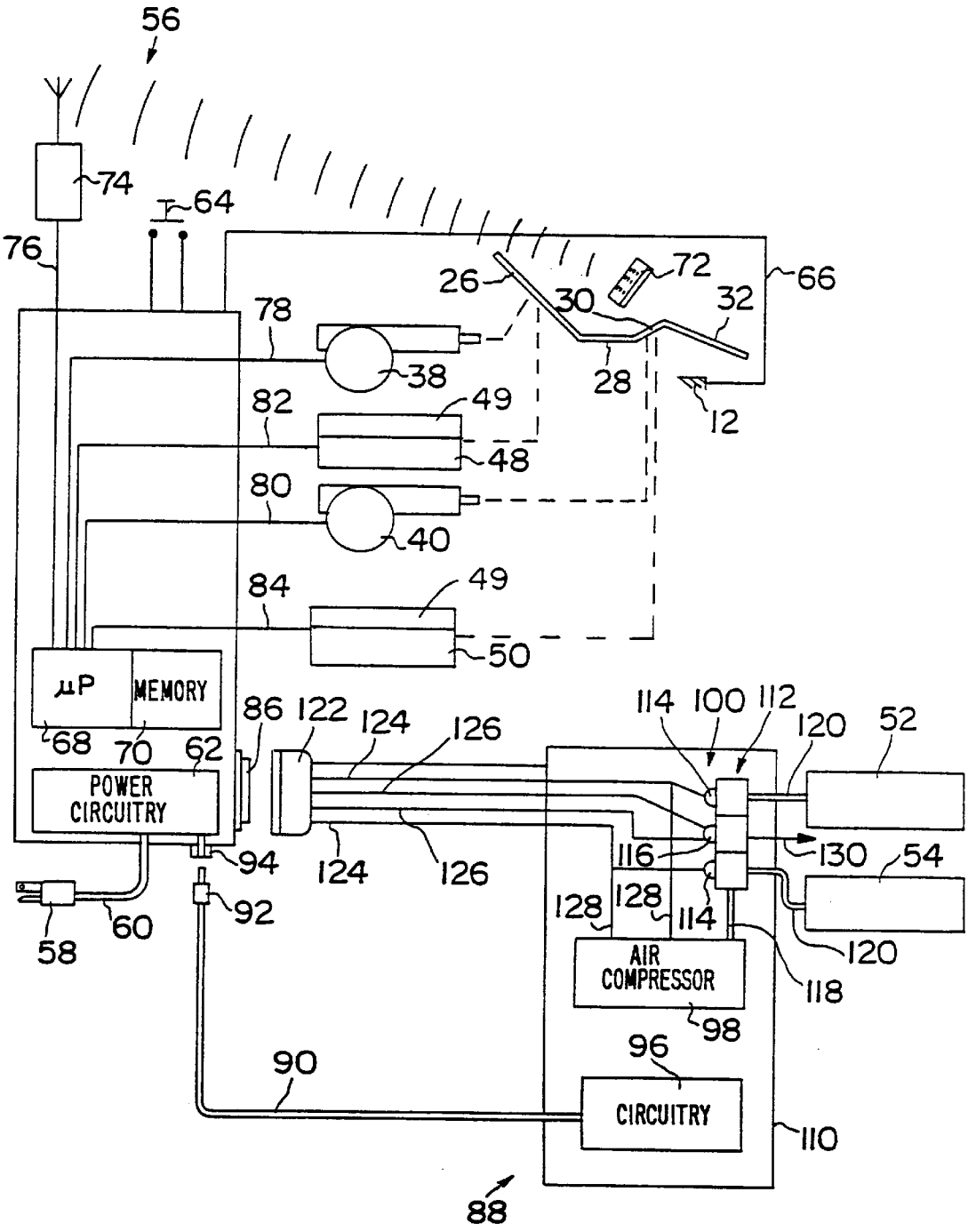
FIG. 4 is a block diagram of the bed assembly of FIG. 2 showing the drive system including a first electrical circuit being electrically coupled to the receiver, electrically coupled to first and second articulation motors, and electrically coupled to first and second massage motors and showing the drive system being coupleable electrically to the air control module, the air control module including a second electrical circuit that receives command signals from the first electrical circuit, a compressor, and a manifold and valve assembly that is coupled pneumatically to the air bladders.

Frame 12 includes a drive system 34 having a housing 36, shown in FIGS. 1–3, and first and second articulation actuators or motors 38, 40, shown diagrammatically in FIG. 4, that are situated inside housing 36. First motor 38 operates to articulate head section 26 relative to base 20 and second motor 40 operates to articulate thigh and foot sections 30, 32 relative to base 20. Thus, motors 38, 40 are operable to move articulating deck 24 so that either mattress 14 or mattress 18 is adjustable to a desired position.

In the illustrated embodiments of FIGS. 1–3, motors 38, 40 are coupled to first and second output shafts 42, 44, respectively, and frame 12 includes a set of links 46 that couple output shafts 42, 44 to the respective frame sections 26, 30. However, it will be understood by those skilled in the art that many different types of mechanical mechanisms and force-transmission elements may be used to articulate sections of a bed frame and thus, the mechanical connections between motors 38, 40 and respective frame sections 26, 30 are shown diagrammatically in FIG. 4 as dotted lines.

Frame 12 further includes a head-end massage motor 48 coupled to head section 26 and a foot-end massage motor 50 coupled to thigh section 30. Massage motors 48, 50 each include an eccentric weight 4 g, the rotation of which vibrates the associated head section 26 and thigh section 30, respectively. Although illustrative motors 48, 50 are mounted directly to respective frame sections 26, 30, it within the scope of the invention as presently perceived for massage motors 48, 50 to transmit vibrations to frame sections 26, 30 through alternative mechanisms (not shown) and thus, each of the mechanical connections between motors 48, 50 and respective frame sections 26, 30 is shown diagrammatically in FIG. 4 as dotted line.

Air mattress 18 is illustratively a queen size mattress. Air mattress 18 includes a set of air bladders 52, 54 as shown in FIG. 2 (in phantom) and as shown diagrammatically in FIG. 4. Each of air bladders 52, 54 is separately inflatable and deflatable to control the firmness and support characteristics of the associated portion mattress 18. Mattress 18 further includes foam elements (not shown) that surround one or more sides of air bladders 52, 54. However, it is within the scope of the invention as presently perceived for mattresses with only air bladders or with air bladders and supporting structures other than foam elements to be included in bed assembly 16 instead of mattress 18.

Twin and full size mattresses (not shown) include only one air bladder. In addition, a king size mattress includes two twin mattresses located side by side. Therefore, each ½ king mattress section only includes one air bladder. Although the drawings and description are related to the queen mattress embodiment, other mattress configurations are within the scope of the present invention.

Frame 12 includes control circuitry 56 which generates signals to control motors 38, 40, 48, 50 and which generates signals to control the inflation and deflation of air bladders 52, 54. Control circuitry 56 includes a plug 58 that couples to an electrical outlet (not shown) to receive standard 110 V, 60 Hz AC electric power which is supplied through a power cord 60 to the other components of control circuitry 56. Control circuitry 56 further includes power circuitry 62 that converts the supplied AC power to power suitable for operating various circuit components of control circuitry 56.

Control circuitry 56 includes a power down switch 64 that is pressed to lower sections 26, 30, 32 to a flat, horizontal position when power supplied via plug 58 and power cord 60 is interrupted. In addition, control circuitry 56 includes a battery, capacitor, or other device (not shown) for storing electric potential to provide auxiliary power to motors 38, 40 so that sections 26, 30, 32 are lowered to the flat, horizontal position. Control circuitry 56 is grounded to frame 12 by a ground wire 66.

Control circuitry 56 includes a microprocessor 68 and memory 70 as shown diagrammatically in FIG. 4. In addition, control circuitry 56 includes other electrical components (not shown) that are well known to those skilled in the art and that supplement the operation of microprocessor 68 and memory 70. Examples of such other electrical components include a clock or oscillator, resistors, and relays.

A hand-held controller 72 is used to send command signals to control articulation of frame 12 and to control the inflation and deflation of air bladders 52, 54. One controller 72 is used for twin, full and each ½ king size beds. Two controllers 72 are used for queen size beds. In the illustrated embodiment, controller 72 is a wireless remote control unit and control circuitry 56 includes a receiver module 74 that receives the command signals from controller 72. However, it is within the scope of the invention as presently perceived for controller 72 to be coupled directly to control circuitry 56 by a wire.

Receiver module 74 is coupled to control circuitry 56 via a line 76. Command signals received by receiver module 74 from hand-held controller 72 are processed by microprocessor 68 and appropriate output signals are generated by microprocessor 68 to control articulation of frame 12 and to control inflation and deflation of air bladders 52, 54. A software program is stored in memory 70 and microprocessor 68 executes the software program to generate the output signals based upon the command signals.

Control circuitry 56 is coupled electrically via lines 78 to articulation motor 38, via lines 80 to articulation motor 40, via lines 82 to massage motor 48, and via lines 84 to massage motor 50. Some of the output signals generated by microprocessor 68 are communicated to motors 38, 40, 48, 50 via respective lines 78, 80, 82, 84 and some of the output signals generated by microprocessor 68 are communicated to an output connector 86. It should be understood that, although lines 76, 78, 80, 82, 84 are illustrated as being coupled directly to microprocessor 68, various other electrical components (not shown) may be included in each of lines 76, 78, 80, 82, 84.

When first configuration bed assembly 10 is converted to second configuration bed assembly 16, by replacing foam mattress 14 with air mattress 18, an air module 88 is coupled electrically to control circuitry 56 and is coupled pneumatically to air bladders 52, 54 of the queen size mattress as shown in FIGS. 2–4. Air module 88 includes a power coupling cable 90 having an end connector 92 that plugs into a power outlet 94 of control circuitry 56. Control circuitry 56 is configured so that some of the electric power received by control circuitry through plug 58 and power cord 60 is diverted to air module 88 through outlet 94, connector 92, and cable 90. Air module 88 includes driver circuitry 96 that uses the power received on cable 90 for operating the components of air module 88 via control signals from lines 124 and 126.

Figure 5:
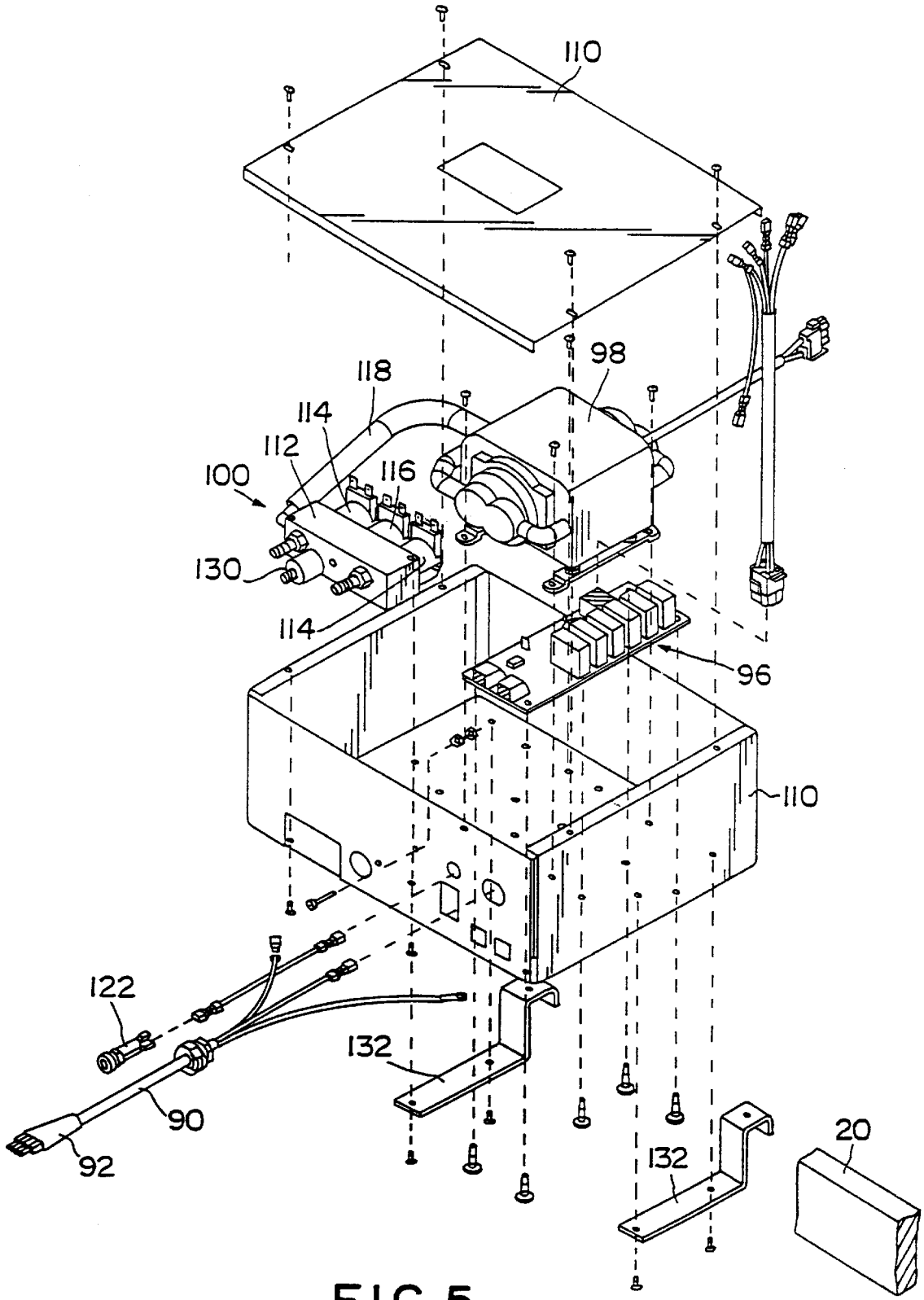
FIG. 5 is an exploded perspective view of the air control module of FIG. 4 showing a housing of the air control module having an interior region that receives the compressor, the manifold and valve assembly, and the second electrical circuit.

Air module 88 includes an air compressor 98 and a manifold and valve assembly 100 as shown diagrammatically in FIG. 4. Compressor 98 and manifold and valve assembly 100 are contained within a housing 110 of air module 88 as shown best in FIG. 5. Manifold and valve assembly 100 includes a manifold block 112, a pair of zone valves 114, and a vent valve 116 as shown in FIGS. 4 and 5. Manifold block 112 is formed to include internal passages (not shown), portions of which are opened and closed by zone valves 114 and by vent valve 116. Air compressor 98 is coupled pneumatically to vent valve 116 by a hose 118 and the internal passages of manifold block 112 are pneumatically coupled to air bladders 52, 54 of a queen mattress by respective pressure-control hoses 120. The pressure in each of air bladders 52, 54 is adjusted by operation of compressor 98 and by manipulation of the position of zone valves 114 and vent valve 116.

Air module 88 includes an electrical input connector 122, shown diagrammatically in FIG. 4, that couples to electrical output connector 86 of control circuitry 56 to receive command signals therefrom. Input connector 122 is coupled electrically via lines 124 to respective zone valves 114 and via lines 126 to vent valve 116. Two connectors 122 are provided for a king system as discussed below. In addition, each of lines 124 is coupled electrically to air compressor 98 via lines 128. The command signals for inflating and deflating air bladders 52, 54 of the queen mattress are transmitted from hand-held controller 72, through control circuitry 56 where they are processed by microprocessor 68, through output connector 86, and through input connector 122 to valves 114, 116 on respective lines 124, 126 to control opening and closing of valves 114, 116. In addition, compressor 98 is operated by signals received thereby on lines 128.

Each of valves 114, 116 are movable between respective opened positions and closed positions. When vent valve 116 is in the closed position, the internal passages of manifold block 112 are decoupled pneumatically from the atmosphere and when vent valve 116 is in the opened position, the internal passages of manifold block 112 are coupled pneumatically to the atmosphere. When air bladders 52, 54 are both at desired pressures, valves 114, 116 are all in the respective closed positions and compressor 98 is turned off. During inflation of either of air bladders 52, 54, the associated zone valve 114 is in the opened position, vent valve 116 is in the closed position, and compressor 98 is turned on to pump air from the atmosphere through hose 118, through the appropriate internal passages of manifold block 112, through the respective pressure-control hoses 120, and into the respective air bladder 52, 54 being inflated. During deflation of either of air bladders 52, 54, the associated valve 114 is in the opened position, compressor 98 is turned off, and vent valve 116 is in the opened position so that air from the respective air bladder 52, 54 being deflated bleeds through the respective pressure-control hoses 120, through the appropriate internal passages of manifold block 112, through vent valve 116, and through an exhaust or pressure relief valve 130 into the atmosphere.

Pressure relief valve 130 of the air system allows control of maximum pressure capability for the air bladders 52, 54. Commercially available compressors typically provide a pressure supply that is greater than the pressure required for adequate firmness in the mattress bladders. If the system is operated without the pressure relief valve 130, the response time to "soften" (reduce pressure) in the mattress is so long that a user typically cannot recognize that the mattress is softening. In other words, a user cannot typically detect a pressure difference when the pressure ranges from about 1.25 to about 3 psi. With the pressure relief valve 130, the response time is minimized because the maximum pressure of each mattress air bladder 52 or 54 is lower. Illustratively, the pressure relief valve 130 is set to vent pressure above about 1–1.25 psi. It is understood that other settings may be used for pressure relief valve 130, if desired.

Thus, according to the present invention, bed assembly 10 is upgraded to bed assembly 16 by removing foam mattress 14 from frame 12, placing air mattress 18 on frame 12, coupling air module 88 electrically to control circuitry 56, and coupling air module 88 pneumatically to air bladders 52, 54. By providing the software program stored in memory 70 with algorithms to control both the articulation of frame 12 and the inflation and deflation of air bladders 52, 54, the same hand-controller 72 that controls bed assembly 10 may be used to control bed assembly 16. In the illustrated embodiment, air module 88 includes a pair of brackets 132, shown best in FIG. 5, that are mounted to housing 110 and that are configured for attachment to rectangular base 20 of frame 12.

As discussed above, for twin and full size bed configurations, only a single air bladder 52 is used. Therefore, only one zone valve 114 and vent valve 116 shown in FIGS. 4 and 5 are required for the twin and full size mattresses. The king size bed is divided into two twin size sections having one bladder 52 or 54 in each twin mattress section. The king control system is illustratively a master/slave configuration. Separate control circuitry 56 is provided for both the master and slave beds. A single air module 88 is used for both the king master and slave beds. An additional connector 122 is provided on the air module 88 for connecting the control circuitry 56 of both the master bed and the slave bed to the housing 110 of the air module 88.

Although the invention has been described in detail with reference to certain preferred embodiments, variations and modifications exist within the scope and spirit of the invention as described and defined in the following claims.

What is claimed is:

1. A method of upgrading a bed assembly from a first configuration in which the bed assembly includes a foam mattress, an articulating frame for supporting the foam mattress, and a drive system for moving at least one section of the articulated frame, to a second configuration in which the bed assembly includes an air mattress, the articulating frame, and the drive system, the method comprising the steps of removing the foam mattress from the articulating frame, placing the air mattress that includes at least one air bladder on the articulating frame, coupling an air control module pneumatically to the at least one air bladder, and coupling the air control module electrically to the drive system so that command signals received by the drive system to adjust pressure of the at least one air bladder are processed by the drive system, the drive system generating output signals that are routed from the drive system on the air control module to operate the air control module to adjust pressure of the at least one air bladder.

2. The method of claim 1, wherein the step of coupling the air control module electrically to the drive system includes the step of coupling an electrical input connector of the air control module to an electrical output connector of the drive system so that the output signals are routed through the electrical output connector and through the electrical input connector.

3. The method of claim 2, wherein the step of coupling the air control module electrically to the drive system further includes coupling a power cable of the air control module to a power outlet of the drive system to receive operating power therefrom.

4. The method of claim 1, further comprising the step of mounting the air control module to the articulating frame.

5. The method of claim 4, wherein the step of mounting the air control module to the articulating frame includes the step of mounting at least one bracket to a housing of the air control module and coupling the bracket to a frame member of the articulating frame.

6. A method of upgrading a bed assembly from a first configuration in which the bed assembly includes a foam mattress, an articulating frame for supporting the foam mattress, and a drive system for moving at least one section of the articulated frame, to a second configuration in which the bed assembly includes an air mattress, the articulating frame, and the drive system, the method comprising the steps of removing the foam mattress from the articulating frame, placing the air mattress that that includes at least one air bladder, and coupling a data input connector of the air control module to a data output connector of the drive system so that command signals received by the drive system to adjust pressure of at least one air bladder are processed by the drive system, the drive system generating output signals that are routed from the drive system through the data output connector and through the data input connector to the air control module to operate the air control module to adjust pressure of the at least on air bladder.

7. A method of upgrading a bed assembly from a first configuration in which the bed assembly includes a foam mattress, an articulating frame for supporting the foam mattress, an actuator for moving at least one section of the articulating frame, and a control circuit coupled to the actuator, to a second configuration in which the bed assembly includes an air mattress, the articulating frame, the actuator, and the control circuit, the method comprising the steps of:

removing the foam mattress from the articulating frame, placing the air mattress that includes at least one air bladder on the articulating frame, coupling an air control module pneumatically to the at least one air bladder, and coupling the air control module electrically to the control circuit so that command signals received by the control circuit to adjust pressure of the at least one air bladder are processed by the control circuit, the control circuit generating output signals that are routed from the control circuit to the air control module to operate the air control module to adjust pressure of the at least one air bladder.

8. The method of claim 7, wherein the step of coupling the air control module electrically to the control circuit includes the step of coupling an electrical input connector of the air control module to an electrical output connector of the output circuit so that the output signals are routed through the electrical output conenector and through the electrical input connector.

9. The method of claim 8, wherein the step of coupling the air control module electrically to the control further includes coupling a power cable of the air control module to a power outlet of the control circuit to receive operating power therefrom.

10. The method of claim 7, further comprising the step of mounting the air control module to the articulating frame.

11. The method of claim 10, wherein the step of mounting the air control module to the articulating frame includes the step of mounting at least one bracket to a housing of the air module and coupling the bracket to a frame member of the articulating member.

12. A method of upgrading a bed assembly from a first configuration in which the bed assembly includes a foam mattress, an articulating frame for supporting the foam mattress, an actuator for moving at least one section of the articulating frame, and a control circuit coupled to the actuator, to a second configuration in which the bed assembly includes an air mattress, the articulating frame, the actuator, and the control circuit, the method comprising the steps of removing the foam mattress from the articulating frame, placing the air mattress that includes at least one air bladder on the articulating frame, coupling an air control module pneumatically to the at least one air bladder, and coupling a data input connector of the air control module to a data output connector of the control circuit so that command signals received by the control circuit, the control circuit pressure of the at least one air bladder are processed by the control circuit, the control circuit generating output signals that are routed from the control circuit through the data output connector and through the data input connector to the air control module to operate the air control module to adjust pressure of the at least one air bladder.

13. A method of upgrading a bed assembly from a first configuration in which the bed assembly includes a mattress, an articulating frame for supporting to mattress, an actuator for moving at least one section of the articulating frame, and a control circuit coupled to the actuator, to a second configuration in which the bed assembly includes an adjustable mattress, the articulating frame, the actuator, and the control circuit, the method comprising the steps of:

placing the adjustable mattress that includes at least one air bladder on the articulating frame, coupling an air control module pneumatically to the at least one air bladder, and coupling the air control module electrically to the control circuit so that command signals received by the control circuit to adjust pressure of the at least one air bladder are processed by the control circuit, the control circuit generating output signals that are routed from the control circuit to the air control module to operate the air control module to adjust pressure of the at least one air bladder.

* * * * *